US009645549B2

(12) United States Patent
Conus et al.

(10) Patent No.: US 9,645,549 B2
(45) Date of Patent: May 9, 2017

(54) BALANCE SPRING WITH COIL SPACER DEVICE

(71) Applicant: ETA SA MANUFACTURE HORLOGERE SUISSE, Grenchen (CH)

(72) Inventors: Thierry Conus, Lengnau (CH); Jean-Luc Helfer, Le Landeron (CH); Andres Cabezas Jurin, Yverdon (CH); Patrick Gasser, Ittigen (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 15/038,577

(22) PCT Filed: Nov. 19, 2014

(86) PCT No.: PCT/EP2014/074976
§ 371 (c)(1),
(2) Date: May 23, 2016

(87) PCT Pub. No.: WO2015/090815
PCT Pub. Date: Jun. 25, 2015

(65) Prior Publication Data

US 2016/0299470 A1 Oct. 13, 2016

(30) Foreign Application Priority Data

Dec. 16, 2013 (EP) ..... 13197321

(51) Int. Cl.
*G04B 17/06* (2006.01)
*G04B 17/26* (2006.01)

(52) U.S. Cl.
CPC ..... *G04B 17/26* (2013.01); *G04B 17/06* (2013.01); *G04B 17/066* (2013.01)

(58) Field of Classification Search
CPC ..... G04B 17/26; G04B 17/06; G04B 17/066
See application file for complete search history.

(56) References Cited

U.S. PATENT DOCUMENTS 3,696,687 A * 10/1972 Harland ..... F16F 1/10 368/175
8,480,294 B2 * 7/2013 Helfer ..... G04B 17/066 368/175

(Continued)

FOREIGN PATENT DOCUMENTS

EP 2 407 831 A1 1/2012
EP 2407831 * 1/2012

(Continued)

OTHER PUBLICATIONS

International Search Report issued Oct. 21, 2015, in PCT/EP2014/074976 Filed Nov. 19, 2014.

(Continued)

*Primary Examiner* — Sean Kayes
(74) *Attorney, Agent, or Firm* — Oblon, McClelland, Maier & Neustadt, L.L.P.

(57) ABSTRACT

A balance spring includes a strip of polygonal section wound on itself into several coils. At least one coil of the balance spring includes a coil spacer device including at least four stop members mounted on the same face and protruding from the thickness of the at least one coil of the strip. Each of the at least four stop members is arranged to enter into contact with the opposite face of another coil of the strip preventing the other coil from touching the at least one coil in the event of a shock.

19 Claims, 2 Drawing Sheets

(56) References Cited

U.S. PATENT DOCUMENTS

| | | | | |
|---|---|---|---|---|
| 8,562,206 | B2 * | 10/2013 | Bossart | G04B 17/066 368/175 |
| 8,764,281 | B2 * | 7/2014 | Zaugg | G04B 17/066 368/175 |
| 8,821,007 | B2 * | 9/2014 | Stranczl | G04B 17/066 368/176 |
| 9,004,748 | B2 * | 4/2015 | Helfer | G04B 17/063 368/175 |
| 2012/0008468 | A1 | 1/2012 | Bossart et al. | |
| 2012/0075963 | A1 | 3/2012 | Zaugg | |

FOREIGN PATENT DOCUMENTS

| | | | |
|---|---|---|---|
| EP | 2 434 353 | A1 | 3/2012 |
| EP | 2434353 | * | 3/2012 |

OTHER PUBLICATIONS

English translation of the Written Opinion issued Oct. 21, 2015 in PCT/EP2014/074976.

* cited by examiner

BALANCE SPRING WITH COIL SPACER DEVICE

This a National Phase Application in the United States of International Patent Application PCT/EP2014/074976 filed Nov. 19, 2014 which claims priority on European Patent Application No 13197321.6 filed Dec. 16, 2013, the entire disclosures of the above patent applications are hereby incorporated by reference.

FIELD OF THE INVENTION

The invention relates to a balance spring intended to reduce the risk of coils sticking to each other in order to improve the working of a resonator in which said spring is used.

BACKGROUND OF THE INVENTION

It is usual, in horology, to form balance springs wherein the strip is coiled substantially in an Archimedean spiral trajectory. However, since new materials such as, for example, crystalline silicon, have been used in horology, it has been observed that sticking may occur between the coils.

SUMMARY OF THE INVENTION

It is an object of the present invention to overcome all or part of the aforementioned drawbacks, by proposing an alternative to the conventional balance spring which prevents coils sticking to each other.

To this end, the invention relates to a balance spring including a strip of polygonal cross-section wound on itself into several coils, characterized in that at least one coil of the balance spring includes a coil spacer device including at least four stop members mounted on the same face and protruding from the thickness of said at least one coil of the strip, each of said at least four stop members being arranged to enter into contact with the opposite face of another coil of the strip preventing the other coil from touching said at least one coil in the event of a shock.

Advantageously according to the invention, the balance spring with the coil spacer device geometrically prevents the risk of sticking between coils by limiting the contact surface at said at least four stop members.

In accordance with other advantageous variants of the invention:

- said at least four stop members are arranged over said same face at an identical angle from each other;
- said at least one coil includes a coil spacer device including four stop members arranged at an angle of 90° or eight stop members arranged at an angle of 45°;
- said at least four stop members protrude from the thickness over at least part or all of the height of the strip;
- said at least two stop members are each in the form of a triangular or pentagonal prism so that one edge faces the surface of said other coil;
- the edge of said at least four stop members facing the surface of said other coil is rounded to offer lower contact pressure in the event of a shock;
- said at least four stop members are each in the form of a semi-discoidal prism to offer lower contact pressure in the event of a shock;
- the overthickness of said at least four stop members represents between 20% and 50% of the nominal thickness of the strip;

- said at least four stop members are at least partially hollowed out to adjust the effect of their mass on the unbalance of the balance spring;
- said at least four stop members are mounted on said same face of the balance spring with the aid of an intermediate base to limit the increase in local rigidity;
- said at least four stop members are distributed over each coil of the balance spring;
- the inner coil is integral with a collet arranged to be secured to an arbor
- the balance spring is formed of a material including silicon;
- the balance is in one piece.

Finally, the invention also relates to a timepiece, characterized in that it includes at least one balance spring according to any of the preceding variants.

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

Figure 1:
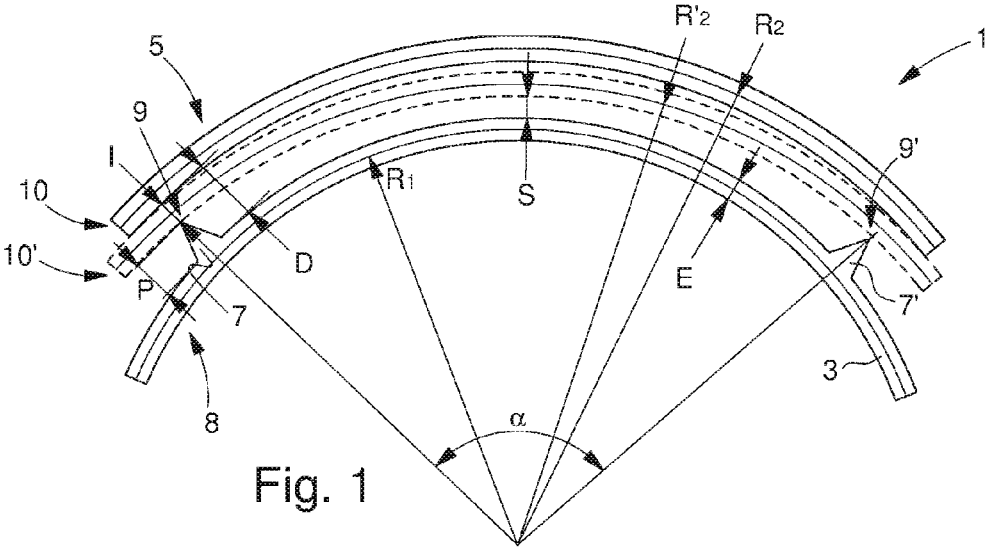
FIG. 1 is a partial top view of a coil spacer device according to the invention.

The present invention relates to a balance spring intended for the field of horology. More specifically, the balance spring is intended to be mounted in a timepiece, for example together with a balance to form a sprung balance resonator forming the regulating member of the timepiece.

As explained above, it has been observed that the use of crystalline silicon springs may cause sticking between the coils. Indeed, the heights H, i.e. the vertical portions, of the coils facing each other are so smooth that adherence can result simply from two coils moving closer together, for example when the timepiece experiences a shock. This adherence may be further increased by contamination of the spring with dirt or lubricant during manufacture or wear.

The balance spring 1, 11, 21, 31, 41, 51, 61, 71, 81, 91 according to the invention includes a strip 3, 13, 23, 33, 43, 53, 63, 73, 83, 93 of length L, of height H and of thickness E forming a preferably rectangular polygonal section, formed by height H and thickness E. It is thus understood that the surface formed along the height of the strip 3, 13, 23, 33, 43, 53, 63, 73, 83, 93 of a first coil faces the opposite surface of the strip on the immediately consecutive coil.

Advantageously according to the invention, to overcome the problems of adherence explained above, at least one coil 8, 10 of the balance spring 1, 11, 21, 31, 41, 51, 61, 71, 81, 91 includes a coil spacer device 5, 15, 25, 35, 45, 55, 65, 75, 85, 95 including at least four stop members 7, 7', 17, 27, 37, 47, 57, 67, 77, 87, 97 mounted on the same face and protruding from the thickness E of said at least one coil of the strip, each of said at least four stop members 7, 7', 17, 27, 37, 47, 57, 67, 77, 87, 97 being arranged to enter into contact with the opposite face of another coil of the strip 3, 13, 23, 33, 43, 53, 63, 73, 83, 93 preventing the other coil from touching said at least one coil in the event of a shock.

FIG. 1 illustrates an example of a balance spring 1 according to the invention which is entirely contracted. FIG. 1 is a partial top view of an example of coil spacer device 5. A first coil 8 formed by strip 3 extends over a first radius $R_1$ relative to the centre of balance spring 1. A second coil 10 formed by strip 3 extends over a second radius $R_2$ relative to the centre of balance spring 1. As balance spring 1 is maximally contracted in FIG. 1, it is understood that the difference between the second radius $R_2$ and the first radius $R_1$ corresponds to the minimum distance D between coils 8 and 10 during normal operation ($R_2-R_1=D$).

In FIG. 1, it is seen that said at least four stop members 7, 7' protrude from the thickness E of the strip to a depth P which leaves a gap I relative to the minimum distance D between the coils (I=D−P) in normal operation. Further, said at least four stop members 7, 7' are distributed over the same face of first coil 8 at an angle α.

In the event of a shock, device 5 for spacing coils 8, 10 prevents the second coil 10 from touching first coil 8. In the diagram of FIG. 1, the second coil 10 is represented by coil 10' in dashed lines. It can be seen that second coil 10', deformed abnormally by a shock enters into contact with said at least four stop members 7, 7' so that second abnormally deformed coil 10' remains at a safety distance S from first coil 8.

After calculation it was determined that, as a good approximation, said at least four stop members 7, 7', 17, 27, 37, 47, 57, 67, 77, 87, 97 should preferably be distributed over the same face of a coil at an angle α of between 45° and 170° depending on the number of stop members per coil. By way of compromise, it appears that an angle of 90° can ensure a satisfactory safety distance S in every timepiece balance spring construction 1, 11, 21, 31, 41, 51, 61, 71, 81, 91. Of course, angle α can be modulated according to the required application.

Figure 2:
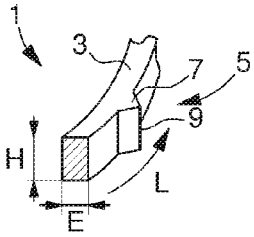
FIGS. 2 and 3 are partial perspective views of two examples of coil spacer devices according to the invention.

According to a first variant illustrated in FIG. 2, balance spring 1 includes a strip 3 provided with a coil spacer device 5 wherein said at least four stop members 7 protrude from thickness E over the entire height H of the strip 3 of balance spring 1. Of course, this first variant is non-limiting as regards the relative height and/or position of said at least four stop members 7 with respect to the height H of strip 3. By way of second variant illustrated in FIG. 3, balance spring 11 includes a strip 13 provided with a coil spacer device 15 wherein said at least four stop members 17 protrude from thickness E over only part of the height H of strip 13.

Evidently, it is possible to envisage combining said at least four stop members 7, 7', 17, 27, 37, 47, 57, 67, 77, 87, 97 of different configurations within the same coil spacer device 5, 15, 25, 35, 45, 55, 65, 75, 85, 95, i.e. for example, alternating stop members 7 of the first variant with stop members 17 of the second variant.

Figure 3:
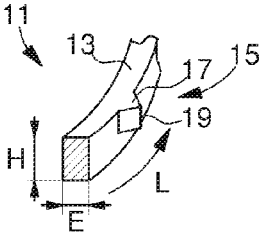

The examples of FIGS. 1 to 3 disclose said at least four stop members 7, 7', 17 each in the form of a triangular prism so that an edge 9, 19 faces the opposite face of another coil. It is easily understood that said at least four stop members 7, 7', 17, 27, 37, 47, 57, 67, 77, 87, 97 should not be limited to this triangular prismatic shape.

Thus, according to alternatives, said at least four stop members 7, 7', 17, 27, 37, 47, 57, 67, 77, 87, 97 may be of a different shape, such as, for example, in a pentagonal or semi-discoidal prismatic shape, with an edge 9, 9', 19, 29, 39, 49, 59, 69, 79, or partially hollowed out, or having a different arrangement, such as, for example, mounted on the same face of the coil but in a different manner.

Figure 4:
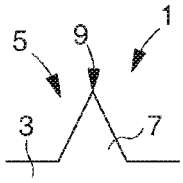
FIGS. 4 to 10 are partial top views of embodiments of coil spacer devices according to the invention.

Example embodiments of coil spacer device 5, 15, 25, 35, 45, 55, 65, 75, 85, 95 according to the invention will be described with reference to FIGS. 4 to 10 and 12 to 13. The first embodiment of FIG. 4 is that already illustrated in FIGS. 1 to 3. It includes a balance spring 1 formed by a strip 3 provided with a coil spacer device 5 including said at least four stop members 7, 7' in the form of a solid triangular prism, directly protruding from the thickness E of strip 3 with a pointed edge 9 which faces the immediately consecutive coil.

Figure 5:
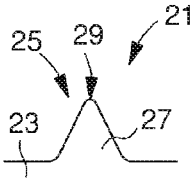

The second embodiment of FIG. 5 is close to that of FIG. 4. Indeed, it includes a balance spring 21 formed by a strip 23 provided with a coil spacer device 25 including said at least four stop members 27 in the form of a solid triangular prism directly protruding from the thickness E of strip 23. However, in this second embodiment, edge 29 which faces the immediately consecutive coil, is rounded to offer lower contact pressure in the event of a shock.

Figure 6:
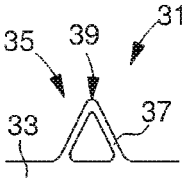

The third embodiment of FIG. 6 is close to that of FIG. 5. Indeed, it includes a balance spring 31 formed by a strip 33 provided with a coil spacer device 35 including said at least four stop members 37 in the form of a triangular prism directly protruding from the thickness E of strip 33 with a rounded edge 39 which faces the immediately consecutive coil. However, in this third embodiment, said at least four stop members 37 are at least partially hollowed out so as to adjust the effect of their mass on the unbalance of balance spring 31.

Figure 7:
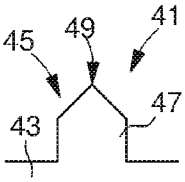

The fourth embodiment of FIG. 7 includes a balance spring 41 formed by a strip 43 provided with a coil spacer device 45 including said at least four stop members 47 in the form of a solid pentagonal prism directly protruding from the thickness E of strip 43 with a pointed edge 49 which faces the immediately consecutive coil.

Figure 8:
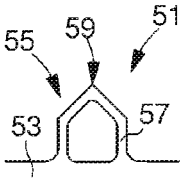

The fifth embodiment of FIG. 8 is close to that of FIG. 7. Indeed, it includes a balance spring 51 formed by a strip 53 provided with a coil spacer device 55 including said at least four stop members 57 in the form of a solid pentagonal prism directly protruding from the thickness E of strip 53. However, in this second embodiment, edge 59 which faces the immediately consecutive coil, is rounded and said at least four stop members 57 are at least partially hollowed out.

Figure 9:
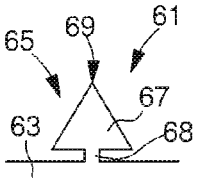

The sixth embodiment of FIG. 9 is close to that of FIG. 4. Indeed, it includes a balance spring 61 formed by a strip 63 provided with a coil spacer device 65 including said at least four stop members 67 in the form of a solid triangular prism directly protruding from the thickness E of strip 63 with a pointed edge 69 which faces the immediately consecutive coil. Thus, in this sixth embodiment, said at least four stop members 67 are mounted on the same face of the balance spring with the aid of an intermediate base 68 of smaller thickness than the base of the triangular prism to limit the increase in local rigidity caused by the localised increase in thickness E on strip 63. The intermediate base 68 is of prismatic shape with a substantially rectangular or square base.

Figure 10:
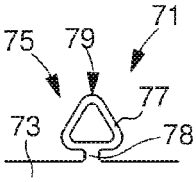

Finally, the seventh embodiment of FIG. 10 is close to that of FIG. 9. Indeed, it includes a balance spring 71 formed by a strip 73 provided with a coil spacer device 75 including said at least four stop members 77 in the form of a triangular prism protruding from thickness E of strip 73 with the aid of an intermediate base 78. However, in this seventh embodiment, edge 79 which faces the immediately consecutive coil is rounded and said at least four stop members 77 are at least partially hollowed out.

Of course, this invention is not limited to the illustrated example but is capable of various variants and modifications which will appear to those skilled in the art. In particular, the seven embodiments are non-limiting, i.e. other forms and/or arrangements may be envisaged.

Figure 12:
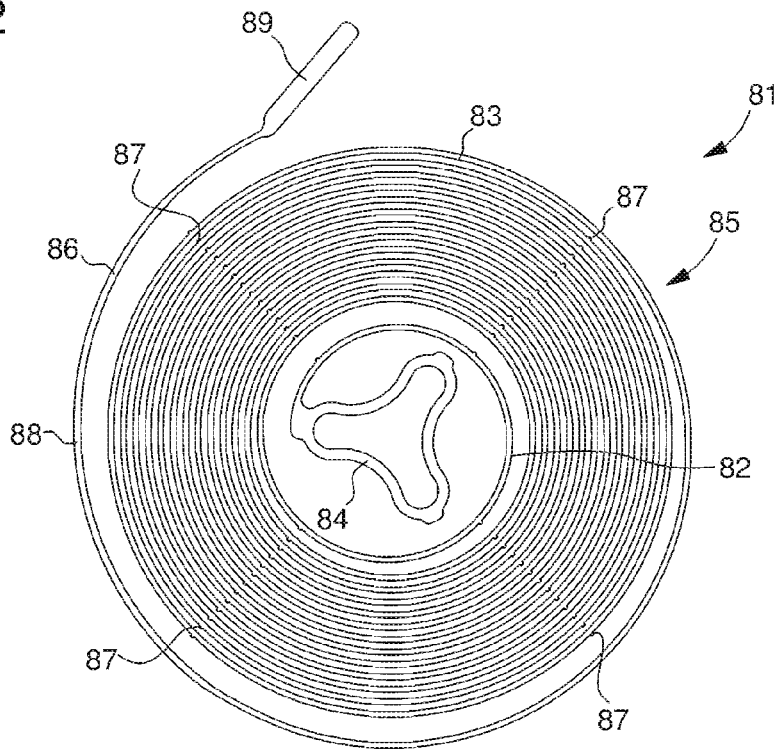
FIGS. 12 and 13 are top views of other embodiments of coil spacer devices according to the invention.

By way of example, said at least four stop members could be partially cylindrical, i.e. have a prismatic base section in the form of a partial disc, such as, for example a semi-cylindrical disc. Thus, the eighth embodiment of FIG. 12 includes a balance spring 81 formed by a strip 83 provided with a coil spacer device 85 including said at least four stop members 87 in the form of a solid semi-discoidal prism directly protruding from the thickness E of strip 83 which faces the immediately consecutive coil. As seen in FIG. 12, strip 83 includes four stop members 87 arranged every 90° on each coil, the four series of stop members 87 forming an alignment every 90° when balance spring 81 is at rest. Further, it is noted that balance spring 81 includes an inner coil 82 whose free end is integral with a collet 84 and whose trajectory follows a Grossmann curve. Balance spring 81 also includes an outer coil 86 whose free end is integral with an attachment portion 89 for pinning balance spring 81 to the balance spring stud, and having one portion 88 which is thickened to offer localised rigidity.

This eighth embodiment proved satisfactory with a strip 83 having a thickness E of 42.5 μm, a distance D at rest of 52 μm, a contraction distance D at 300° of 26 μm and a depth P of 10 to 15 μm. It is understood that a depth P of between 20% and 50% of the thickness of strip 83 is sufficient to ensure an effective spacer device 85.

Figure 13:
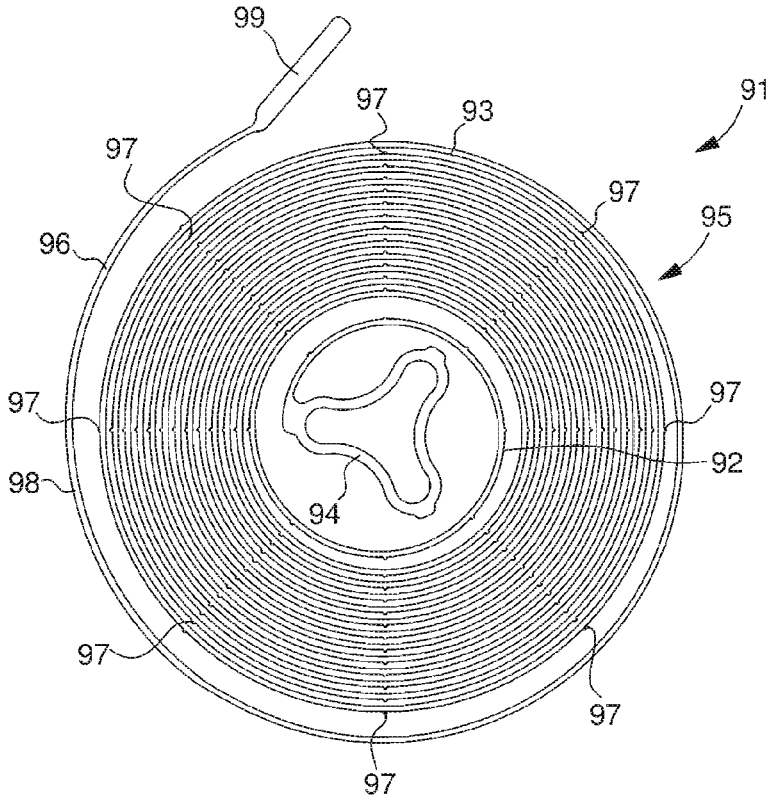

The ninth embodiment of FIG. 13 includes a balance spring 91 formed by a strip 93 provided with a coil spacer device 95 including said at least eight stop members 97 in the form of a solid semi-discoidal prism directly protruding from the thickness E of strip 93 which faces the immediately consecutive coil. As seen in FIG. 13, strip 93 includes eight stop members 97 arranged every 45° on each coil, the eight series of stop members 97 forming an alignment every 45° when balance spring 91 is at rest. Further, it is noted that balance spring 91 includes an inner coil 92 whose free end is integral with a collet 94 and whose trajectory follows a Grossmann curve. Balance spring 91 also includes an outer coil 96 whose free end is integral with an attachment portion 99 for pinning balance spring 91 to the balance spring stud, and having one portion 98 which is thickened to offer localised rigidity.

Figure 11:
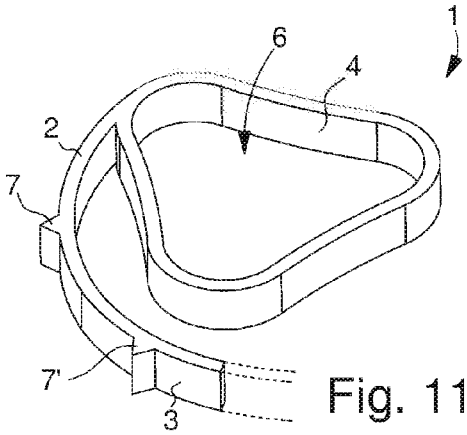
FIG. 11 is a partial perspective view of a collet and of the start of the inner coil of a balance spring according to the invention.

Of course, like the eighth and ninth embodiments, the balance spring 1, 11, 21, 31, 41, 51, 61, 71 according to the other embodiments may also include an inner coil which is integral with a collet arranged to be secured to an arbor as illustrated in the example of FIG. 11.

FIG. 11 partially shows a balance spring 1 formed by a single strip 3 whose inner coil 2 is provided with a coil spacer device 5 including said at least four stop members 7, 7' in the form of a triangular prism protruding from the thickness E of strip 3, the inner coil 2 being integral with a collet 4. Collet 4, which is substantially trefoil-shaped, includes a hole 6 intended, for example, to receive a balance staff.

It is thus understood that it is possible to envisage combining one or more embodiments of FIGS. 1 to 13 on the same coil surface and/or on at least two consecutive coils without departing from the scope of the invention.

It is clear from reading the above examples that the balance spring 1, 11, 21, 31, 41, 51, 61, 71, 81, 91 may be in one piece, i.e. the strip 3, 13, 23, 33, 43, 53, 63, 73, 83, 93 is formed with no discontinuity of material. Such a balance spring 1, 11, 21, 31, 41, 51, 61, 71, 81, 91 may be formed of a material including silicon, i.e., for example, single crystal silicon, polycrystalline silicon, doped single crystal silicon, doped polycrystalline silicon, amorphous silicon, porous silicon, doped or undoped silicon carbide, doped or undoped silicon nitride, doped or undoped silicon oxide such as quartz or silica. Indeed, an anisotropic etch of such materials can be accomplished by wet or dry methods.

The invention claimed is:

1. A balance spring, comprising:

a strip of polygonal section wound on itself into several coils, wherein at least one coil includes a device for spacing apart the coils including at least four stop members mounted on a same face and protruding from a thickness of the at least one coil of the strip, each of the at least four stop members being arranged to enter into contact with an opposite face of another coil of the strip preventing the other coil from touching the at least one coil in the event of a shock.

2. The balance spring according to claim 1, wherein the at least four stop members are distributed over the same face at an identical angle to each other.

3. The balance spring according to claim 2, wherein the at least four stop members includes four stop members are distributed at an angle of 90°.

4. The balance spring according to claim 2, wherein the at least four stop members includes eight stop members distributed at an angle of 45°.

5. The balance spring according to claim 1, wherein the at least four stop members protrude from the thickness over at least part of a height of the strip.

6. The balance spring according to claim 5, wherein the at least four stop members protrude from the thickness over an entirety of the height of the strip.

7. The balance spring according to claim 1, wherein the at least four stop members are each in a shape of a triangular prism so that an edge is opposite the face of the other coil.

8. The balance spring according to claim 7, wherein the edge of said at least four stop members opposite the face of said other coil is rounded to offer lower contact pressure in the event of a shock.

9. The balance spring according to claim 1, wherein the at least four stop members are each in a shape of a pentagonal prism so that an edge is opposite the face of the other coil.

10. The balance spring according to claim 9, wherein the edge of the at least four stop members opposite the face of the other coil is rounded to offer lower contact pressure in the event of a shock.

11. The balance spring according to claim 1, wherein the at least four stop members are each in a form of a semi-discoidal prism to offer lower contact in the event of a shock.

12. The balance spring according to claim 1, wherein an overthickness of the at least four stop members represents between 20% and 50% of a nominal thickness of the strip.

13. The balance spring according to claim 1, wherein the at least four stop members are at least partially hollowed out to adjust an effect of a mass thereof on an unbalance of the balance spring.

14. The balance spring according to claim 1, wherein the at least four stop members are mounted on the same face of the balance spring with aid of an intermediate base of smaller thickness than a prismatic base of the at least four stop members to limit an increase in local rigidity.

15. The balance spring according to claim 1, wherein the at least four stop members are distributed over each coil of the balance spring.

16. The balance spring according to claim 1, wherein the inner coil is integral with a collet arranged to be secured to an arbor.

17. The balance spring according to claim 1, wherein the balance spring is in one piece.

18. The balance spring according to claim 1, wherein the balance spring is formed of a material including silicon.

19. A timepiece, comprising:

at least one of the balance spring according to claim 1.

* * * * *